United States Patent [19]

King

[11] Patent Number: 4,746,042

[45] Date of Patent: May 24, 1988

[54] PORTABLE PAINT BRUSH HOLDER AND KIT

[76] Inventor: Richard C. King, 6380 Almaden, San Jose, Calif. 95120

[21] Appl. No.: 866,131

[22] Filed: May 21, 1986

[51] Int. Cl.[4] ..... A45F 5/00

[52] U.S. Cl. ..... 224/148; 224/197; 224/904; 224/252

[58] Field of Search ..... 224/148, 197, 252, 253, 224/269, 904, 907; 206/362, 362.4, 362.2; 220/85 R; 15/248 R

[56] References Cited

U.S. PATENT DOCUMENTS

| | | | |
|---|---|---|---|
| 1,083,772 | 1/1914 | Taylor | 15/248 R |
| 3,250,448 | 5/1966 | Clark | 224/252 |
| 3,294,298 | 12/1966 | Danielson . | |
| 3,493,152 | 2/1970 | Ort . | |
| 3,535,709 | 10/1970 | Johannes | 224/148 |
| 3,878,589 | 4/1975 | Schaefer | 224/269 X |
| 4,172,542 | 10/1979 | Lankford | 224/148 |
| 4,299,345 | 11/1981 | Lanzl | 224/252 |
| 4,303,188 | 12/1981 | Calabrese | 224/253 |
| 4,358,036 | 11/1982 | Maltais | 224/252 |
| 4,363,433 | 12/1982 | Jaques | 224/253 |
| 4,369,890 | 1/1983 | Bennett | 220/90 X |
| 4,436,217 | 3/1984 | Ritter | 220/85 D |

FOREIGN PATENT DOCUMENTS 3228917 2/1984 Fed. Rep. of Germany .

*Primary Examiner*—Henry J. Recla
*Assistant Examiner*—David Voorhees
*Attorney, Agent, or Firm*—Phillips, Moore, Lempio & Finley

[57] ABSTRACT

The present invention relates to an improved portable paint brush holder (or holster). The paint brush holder has means (such as a clip, loops, a stud and loop and the like) for attaching the brush holder to a belt of the painter and is a substantially rectangular container having a top opening to hold the paint brush in a upright position with the handle of the brush pointing up. The invention holds the wet paint brush securely, prevents paint drips and prevents drying of the paint on the brush. The invention also includes a kit comprising the portable paint brush holder which is detachably engaged to the belt of the painter and a clip for permanent attaching to the flat portion of the paint brush at the bristle-handle interface. The clip on the brush aids in securing the paint brush within the paint brush holder reservoir.

1 Claim, 2 Drawing Sheets

PORTABLE PAINT BRUSH HOLDER AND KIT

BACKGROUND OF THE INVENTION

1. Field of the Invention

This invention relates to a portable paint brush holder. More specifically, the present invention relates to a portable paint brush holder which is attached, (and optionally detachable), to the belt of the painter. The paint brush holder improves the efficiency of painting houses, buildings and similar objects. The invention also optionally includes one or more clips to be attached to the flat portion of a paint brush to better secure the brush to the holder.

2. Relevant Art

The desirability of having a paint brush container (holder or holster) attached to a person has long been recognized. Some devices which have been reported generally take the form of a belt having a fixed paint carrier and brush holder attached to the front of the belt as described by G. Chindgren in U.S. Pat. No. 1,109,161 or as an apron as described by B. A. Walsh in U.S. Pat. No. 2,717,109.

More recently, R. L. McGuire discloses in U.S. Pat. No. 2,985,349 a painter's pail and brush holder for use on the person of thepainter. However, the paint brush handle in this patent is forced into an inconvenient spring clamp holder.

In U.S. Pat. No. 3,493,152, W. Ort discloses a convex shield for attachment to the belt of the painter which supports a bucket of paint and pressure clips to hold the handles of the paint brushes.

In U.S. Pat. No. 4,172,542, W. O. Lankford discloses a paint can holder and supporting member.

In U.S. Pat. No. 4,325,503, G. E. Swinney discloses a carrier for holding a paint bucket and brush holder secured to the painter's belt. The rack and member are connected to provide relative movement between them so that the weight of the bucket and rack maintains the bucket in an upright position as the painter moves about his work while dampening its tendency to oscillate too freely. The pivotal motion is in the plane perpendicular to the painter's body.

In U.S. Pat. No. 4,436,217, J. C. Ritter discloses a paint brush support that is attached to the outer portion of a paint container. The brush container has an opening to fit snugly over the bale support button and also uses an elastic ring engageable with the paint container which holds the brush support container snugly to the paint container.

In U.S. Pat. No. 4,363,433, D. Jaques discloses a painter's holster which has loops to attach to the belt of the painter and a large rectangular paint reservoir having a downwardly beveled top opening for easy access to the paint reservoir. Small V-shaped openings are included attached to the reservoir to hold one or more of the paint brushes.

A number of patents disclose the attachment of various receptacles to a belt or other item, including, for example:

| U.S. Pat. No. | Patentee | Attachment |
|---|---|---|
| 873,099 | W. O. Shepart, et al. | Clip |
| 1,148,369 | C. A. Farmer | Clip |
| 3,294,298 | R. E. Danielson | Closed loop |
| 3,342,387 | J. H. Ryan | Hook |
| 3,777,953 | J. Lewis | Clip |

-continued

| U.S. Pat. No. | Patentee | Attachment |
|---|---|---|
| 3,878,589 | H. A. Schaefer | Stud and Shaped opening |
| 4,303,188 | M. A. Calabrese | Closed loop |
| 4,358,036 | W. A. Maltais | Clip |

The above cited patents are relevant to the Applicant's invention in that they represent the closest art known for a portable paint brush holder and a kit. The devices are generally convenient to keep brushes and paint within easy reach of the painter. These types of devices are essential for safety and efficiency when painting from ladders, scaffolds, roofs and the like in that they free up at least one hand of the painter for climbing. However, the devices of the art are often inconvenient and present problems in many respects. None of the references, individually or collectively, disclose or anticipate the improved portable paint brush holder attached to the belt of the painter as is described herein.

SUMMARY OF THE INVENTION

The present invention which is described in greater detail hereinafter and in the appended claims, comprises a portable paint brush holder, optionally releaseably attached to a belt of the painter. The holder is in the form of an open top vessel having a substantially rectangular reservoir having a substantially planar bottom, side walls and front and rear wall each sealingly connected to one another. The exterior back wall of the paint brush holder is attached to a belt of the painter by connective means which includes one or more clips, loops, bands, studs, rivets, pivots, key-hole like openings and the like. The paint brush optionally may have a clip on one of its flat surfaces to more firmly attach the paint brush to the front wall of the paint brush holder.

It is therefore a primary object of the present invention to provide a new and improved portable paint brush holder (or holster).

It is a object of the present invention to provide a portable paint brush holder which is optionally detachable from the support or belt on the person of the painter.

It is a further object of the present invention to provide a paint brush holder having a substantially rectangularly-shaped brush container which holds a brush with its handle standing up for the unobstructed grasping of the handle by the painter.

It is another object of the present invention to provide a new and improved portable paint brush holder that is economical to manufacture and convenient to use.

Further objects, advantages, applications and embodiments of the present invention will become apparent to those skilled in the art of painting and painting implement holders when the examples contemplated for practicing the invention as are described herein are read in conjunction with the accompanying drawings and the claims appended hereto. Additional objects and advantages will become apparent and a more thorough understanding of the present invention will be had from the following description taken in conjunction with the accompanying drawings which form a part of this invention.

BRIEF DESCRIPTION OF THE DRAWINGS

The description herein makes reference to the accompanying drawings wherein like reference numbers refer to like parts throughout the several views and wherein.

DETAILED DESCRIPTION OF THE INVENTION

Figure 1:
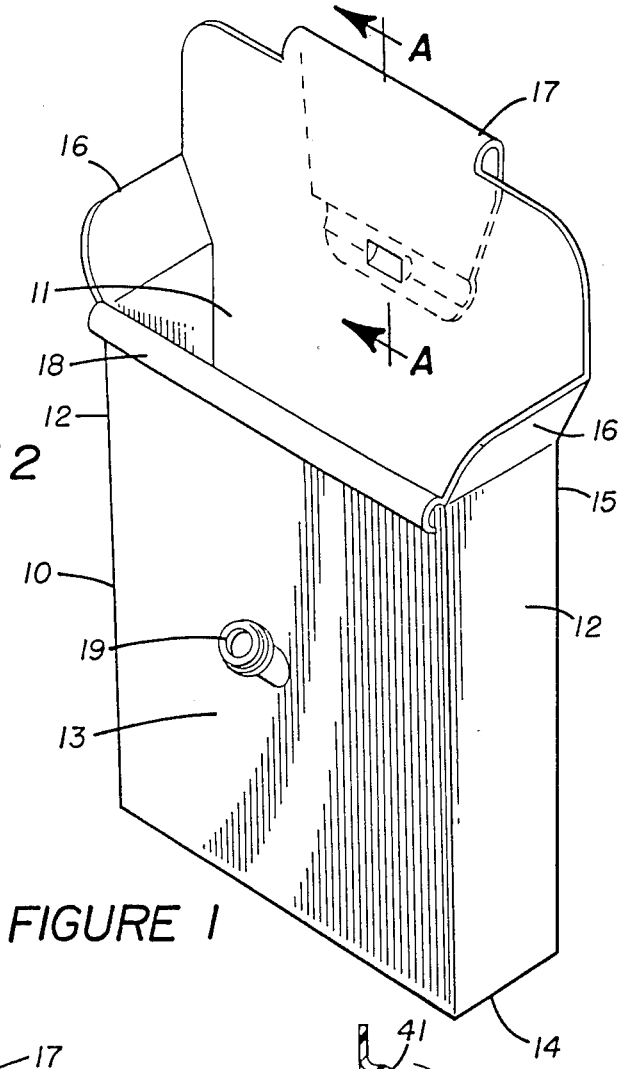
FIG. 1 illustrates a front perspective view of the paint brush holder of the present invention.

Referring now to the drawings, in FIG. 1, portable paint brush holder 10 includes a substantially rectangular reservoir 11 which includes two opposed side walls 12, a front wall 13, a bottom wall 14, back wall 15, splashguard area 15A, angled flanges (side splashguards) 16 and attachment means 17. The walls 12, 13 and 15 and bottom 14 are sealingly connected to one another to make a fluid-tight container. A preferred length of the reservoir formed is between about 4 to 8 inches long, a thickness of between about 0.5 and 2 inches and between about 4 and 7 inches wide. The front wall 13 is between 4 to 7 inches in height and the rear wall 15 (including splashguard 15A) has an overall height of between about 6 to 10 inches. A more preferred size of the reservoir is about 6 inches high, 6 inches wide and about 2 inches thick.

Although the Figures show the paint brush holder having square corners and edges, these corners and edges may be rounded, within the present invention, to aid in the manufacturing process and also for increased comfort when worn on the belt of a painter. The paint brush holder attached to a belt or similar support may be worn at any position on the lower torso of the painter. Preferably, it is placed to one side or the other generally resting loosely on or near the painter's hip.

The paint brush holder is made of any material which is not attacked by or reactive with the paint used, including, for example, metals such as aluminum or steel or steel ("tin") plate and the like, glass, ceramic, paper, and plastics such as polyvinyl chloride, polyethylene, polypropylene, polycarbonate and the like. Poly(vinyl chloride) is a preferred material of manufacture. Another preferred embodiment is holder 10 manufactured from paper which is inexpensive, and the paper holder may be discarded after each day's use.

Figure 3:
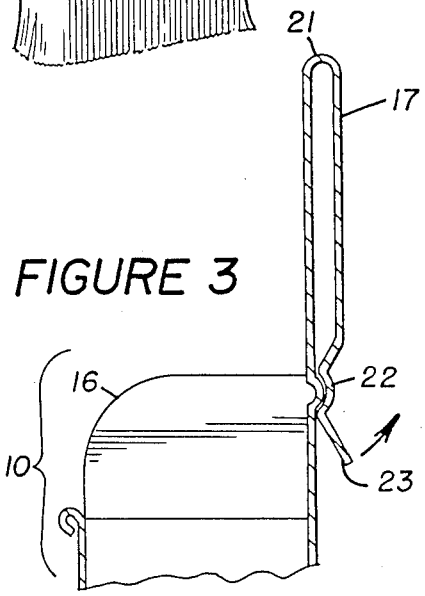
FIG. 3 illustrates a cross-sectional view of a self-locking attaching means of the paint brush holder of the present invention taken along line A—A of FIG. 1.

On the exterior of rear wall 15 of holder 10 is the means by which the paint brush holder is attached to the belt of the painter. In one embodiment, this is accomplished as is shown in FIG. 1 by use of integrally formed clip 17. Clip 17 is shown in FIG. 3 in partial cut-away view at line A—A of FIG. 1 wherein loop 21 provides the spring action to close the clip at a pair of interengaging arcuate clip portions 22 projecting outwardly from the holder. In this embodiment, holder 10 can be easily removed by spring opening the clip 17 in the direction shown by the arrow at point 23. In another embodiment, clip 17 has an inverted U-shape and is open on the bottom at point 22 (preferably one).

Figure 4:
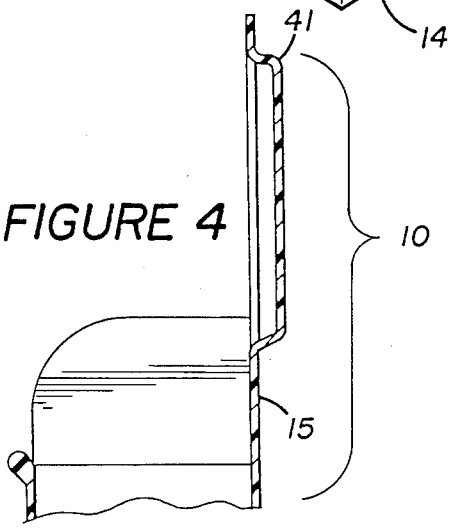
FIG. 4 illustrates another cross-sectional view of a different attaching embodiment of the paint brush holder of the present invention as a closed loop means to connect the holder to a belt, also generally taken along line A—A of FIG. 1.

FIG. 4 also shows a partial cut-away view along line A—A of FIG. 1, however the attaching means embodiment here is closed loop 41. In this embodiment, one or more horizontally spaced loop members 41 are on the exterior rear-most planar surface 15. The loop 41 is located adjacent to the top of the back wall 15 and may be of any size suitable to accommodate a standard sized belt inserted through loop 41.

Figure 2:
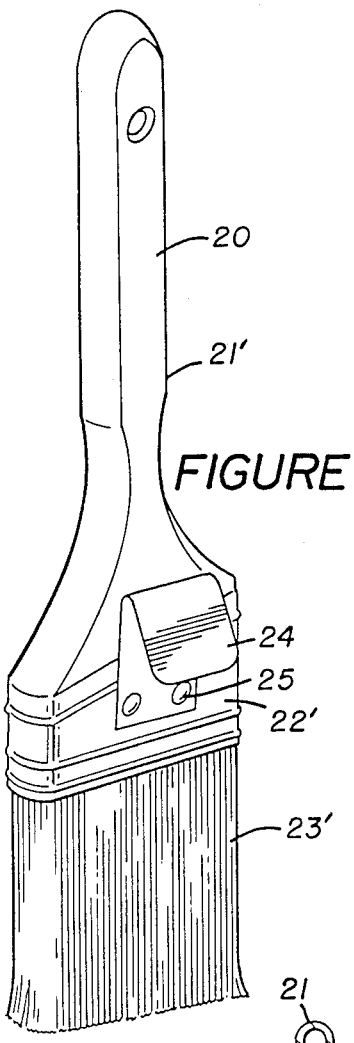
FIG. 2 illustrates a front perspective view of a paint brush and clip which is optionally used to secure the brush to the front wall of the paint brush holder as a part of the present invention.

FIG. 2 shows a standard sized paint brush 20 which may be used for interior or exterior painting, having a handle 21', metal band 22', and bristles 23', and means 24 to more securely engage the paint brush to the paint brush holder. In the embodiment shown in FIG. 2, the securing means 24 is a tension clip which engages the front wall 13 at the top at about edge 18. The clip 24 is shaped as shown as an upside down "U" in which the open ends of the "U" has been compressed. In this way, the clip attaches tightly to the front edge 18.

It is also possible for the attachment means (clip 24) may be shaped like an inverted "U" so that brush 20 is fairly loose on edge 18 and still above the level of the paint which collects in the bottom of holder 10. Clip 24 is attached to brush 20 by any suitable permanent means. In FIG. 2 the present invention attaching means are nails or rivets 25. Any similar mechanical means such as screws, staples or the like are also contemplated. The attachment of clip 24 to brush 20 may also occur by adhesive means, using any suitable glue or adhesive which is impervious to the paint and solvents. Epoxy based glues are preferred.

In FIG. 1 and FIG. 2 the attaching means on paint brush 20 need not be a clip. It is within the contemplation of this invention to use a permanent magnet attached to the surface of brush 20 with a corresponding magnet attached within the interior of front surface 13. The magnets attach to hold the paint brush within the reservoir but brush 20 can be removed from holder 10 with a normal force of the arm. If steel or iron is used to fabricate holder 10, then only one magnet is needed to be attached to brush 20.

It is also contemplated that the invention will be sold as the holder 10 is preferably manufactured of inexpensive plastic or paper. It is also contemplated that the holder 10 and clip 24 together are sold as a kit for use in the painting industry or for home or industrial use.

In FIG. 1, a standard fitting 19, projecting outwardly from front wall 13, is optionally located on front wall 13 as a means of conveniently introducing paint into holder 10 from a spray paint nozzle. Often the painter has only a paint spray hose and nozzle on a scaffold. Fitting 19 allows for fairly smooth quantities of paint to be easily introduced into holder 10 so that the pace and efficiency of the painting is not decreased. A similar fitting 19A is shown secured to a sidewall of the holder shown in FIG. 7.

Figure 5:
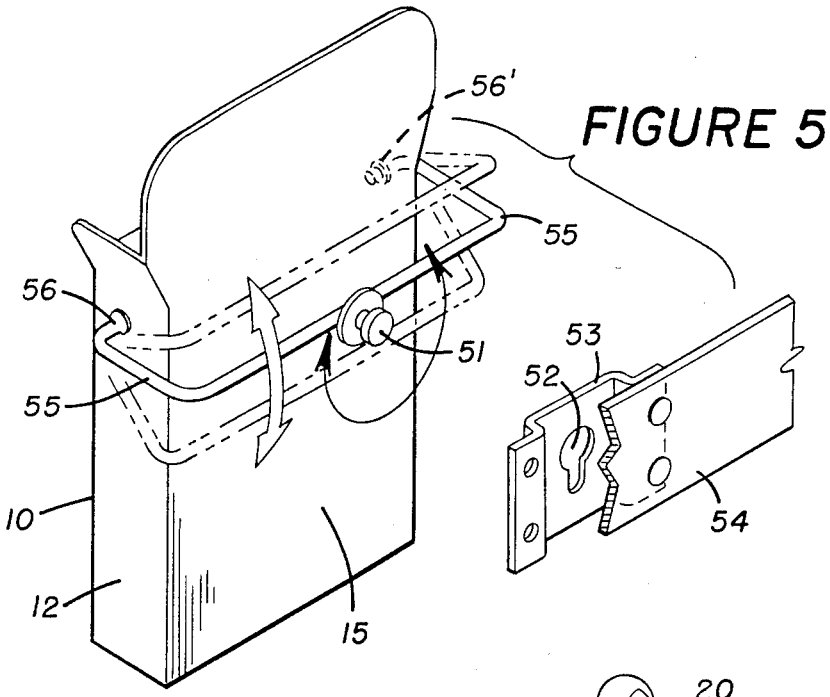
FIG. 5 illustrates a rear perspective view of a detachable means for attaching the paint brush holder to a painter's belt or similar article. This embodiment makes it possible for the holder to rotate along different axes.

FIG. 5 shows another embodiment of the present invention where holder 10 having a front wall 13, opposing sides 12, and rear wall 15. In this embodiment the attaching means to the belt is stud (or rivet) 51 which detachably engages with the sloped keyhole-like opening 52 in plate 53. Plate 53 is permanently attached to belt 54. Stud 51 is connected to holder 10 at both opposing sides 12 by means of the curved rod 55. In this way, holder 10 is easily detached from the belt when desired, by separating stud 51 from hole 52. Further holder 10 will rotate about the axis through points 56 and also rotate about the axis through stud 51. The weight of the paint in holder 10 helps to maintain a vertical orientation of the paint holder and paint brush when it is on the body of the painter. It also provides more freedom of motion for the painter.

Any of the stud-female opening configurations described herein allow for pivotal motion about the stud to keep the paint brush holder in a generally vertical orientation during use.

Figure 6:
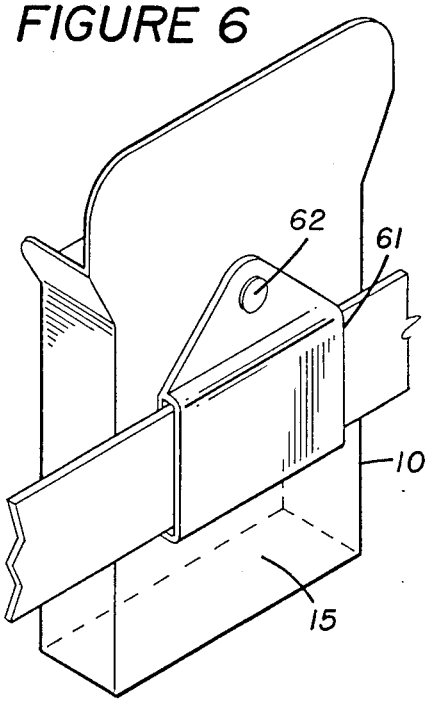
FIG. 6 illustrates a rear perspective view of a solid loop means for attaching to the exterior of the rear wall of the paint brush holder to the belt of a painter.

FIG. 6 shows holder 10 and the exterior of rear wall 15 to which is attached closed loop 61 at rivet or stud 62. Rivet or stud 62 may be either immobile or may be loose so that holder 10 revolves about the axis through stud 62. All studs or rivets are male, and may be rigidly or rotatably attached.

Figure 7:
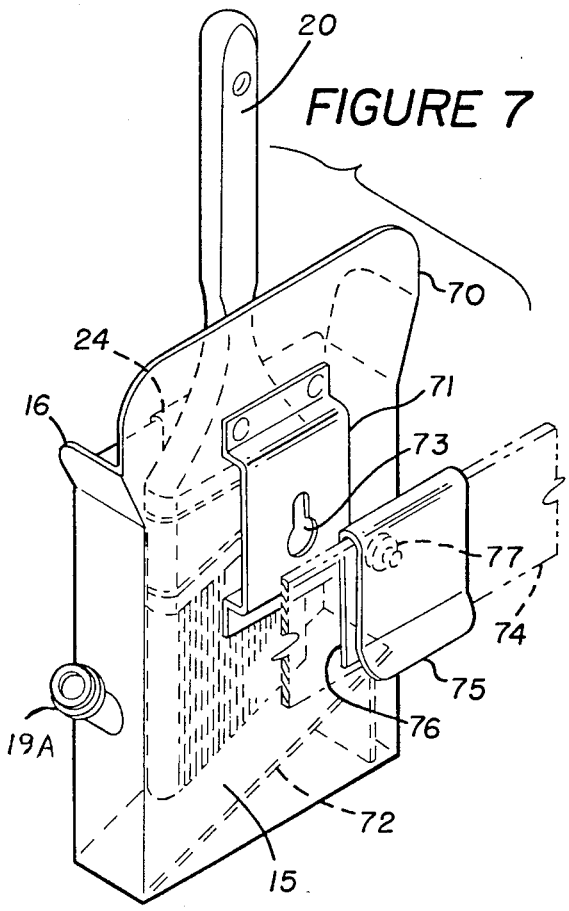
FIG. 7 illustrates a rear perspective view of a stud (or rivet) means for attaching the paint brush holder to a detachable clip which is attached to a belt. In this embodiment the holder has one plane of rotation about the rivet. This embodiment also has an open wedge device inside the paint brush holder to assist in keeping the brush bristles above the level of the paint in the holder.

FIG. 7 shows a rear perspective in partial cut-away view in which plate 71 attached to the back wall 15 of holder 70 is similar in design to plate 53. In this embodiment, plate 71 has an inverted key-hole-like opening 73. On the painter's belt 74 is attached a detachable clip 75 having a general inverted "U" shape so that belt clip 75 is attached securely. Clip 24 on paint brush 20 may also take the shape of clip 17 as is shown in FIG. 3. On exterior face 76 of clip 75 is securely attached a rivet (or stud) 77 which fits securely (but removeably) into inverted keyhole opening 73. The reverse configuration is also possible, i.e., the stud may also be on holder 70 with the female opening on the plate attached to the belt 74 or clip 75. Optionally, the paint brush holder 70 will include a loosely fitting angled article 72 (" 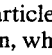 ") in the bottom of the holder 70 as shown, which aids in keeping the paint brush bristles above the level of the paint in holder 70. The angled article 72 may be made of plastic which is impervious to the paint and solvents used or of metal.

A kit is also contemplated which includes the holder 70, paint brush 20, optionally the attachable clip 24 and optionally the triangular article 72 to aid in the art of painting.

Kits are also contemplated which include any combination of paint brush holder attachment means, clips for attachment to the paint brush, clip to attach to the belt of the painter and optionally the angled article, as are described herein.

While the present invention has been described herein with reference to the specific embodiments thereof, it is to be understood by those skilled in this art that various changes may be made and equivalents may be substituted without departing from the true spirit and scope of the present invention. In addition, many modifications may be made to adapt to a particular situation, material or article within the spirit and scope of this invention, without departing from its essential teachings.

I claim:

1. A portable paint brush holder for carrying a wet paint brush on the person of the painter attachable to the belt of the painter by attachment means, the paint brush holder comprising:

(a) a bottom portion, vertical front wall, vertical rear wall, vertical opposing sidewalls forming an enclosure defining a receptacle having a top opening for receiving the brush portion of a conventional paint brush having the handle of the paint brush extending upwardly, wherein the vertical rear wall and sidewalls of the paint brush holder adjacent to the person of the painter includes splashguard means extending above said enclosure for preventing the splashing of paint on the person of the painter, said splashguard means being higher than the front wall of the enclosure away from the person of the painter, including angled and upwardly flared side splashguard means extending outwardly from the top side portions of the opposing sidewalls to prevent the paint from splashing onto the person of the painter;

(b) single attachment means for attaching the paint brush holder to the belt of the painter wherein said attachment means is located on the exterior surface of the paint brush holder adjacent to the person of the painter and comprises a downwardly opening spring clip having an inverted U-shaped closed top loop portion and a self locking bottom portion including a pair of interengaging arcuate clip portions projecting away from the rear wall of said holder, and fitting means, separate and apart from the top opening of said receptacle, secured on an outer side of one of said front wall and sidewalls to project outwardly therefrom for communicating paint within said receptacle.

* * * * *